US006968983B2

(12) United States Patent
Laible

(10) Patent No.: US 6,968,983 B2
(45) Date of Patent: Nov. 29, 2005

(54) CLOSED LOOP DISPENSING SYSTEM

(76) Inventor: Rodney Laible, 16315 Pawnee Rd., Bennington, NE (US) 68007

( * ) Notice: Subject to any disclaimer, the term of this patent is extended or adjusted under 35 U.S.C. 154(b) by 6 days.

(21) Appl. No.: 10/372,375

(22) Filed: Feb. 22, 2003

(65) Prior Publication Data

US 2003/0150887 A1 Aug. 14, 2003

Related U.S. Application Data

(63) Continuation-in-part of application No. 10/074,469, filed on Feb. 12, 2002, now abandoned.

(51) Int. Cl.[7] ..... B67D 5/60
(52) U.S. Cl. ..... 222/464.1; 222/481.5; 222/518; 222/529
(58) Field of Search ..... 222/383.3, 464.1, 222/481.5, 518, 527, 529, 537, 547

(56) References Cited

U.S. PATENT DOCUMENTS

| | | | | |
|---|---|---|---|---|
| 4,401,272 A | | 8/1983 | Merton et al. | 239/337 |
| 5,048,723 A | | 9/1991 | Seymour | 222/81 |
| 5,350,091 A | | 9/1994 | Leete et al. | 222/529 |
| 5,368,205 A | | 11/1994 | Groh | 222/189.06 |
| 5,472,124 A | | 12/1995 | Martushev | 222/529 |
| 5,803,311 A | * | 9/1998 | Fuchs | 222/105 |
| 5,988,456 A | | 11/1999 | Laible | 222/464.1 |
| 6,062,435 A | | 5/2000 | Hess, III | 222/175 |
| 6,299,037 B1 | | 10/2001 | Lee | 222/518 |
| 6,364,163 B1 | * | 4/2002 | Mueller | 222/83 |

* cited by examiner

*Primary Examiner*—Joseph A. Kaufman
(74) *Attorney, Agent, or Firm*—Thomte, Mazour & Niebergall; Dennis L. Thomte

(57) ABSTRACT

A closed loop dispensing system for use on a liquid container such as a bottle or the like for dispensing the liquid contents from the bottle. The outlet opening of the bottle is closed by a throat plug having a valve positioned therein which is open when the container cap is mounted on the container, but which automatically closes when the cap is removed from the container. An inlet opening is provided in the container insert so that liquid may be drawn therethrough. A closure cap is mounted on the bottle and has a dispensing tube extending therefrom for dispensing liquid from the container to a mixing machine or the like. A check valve is associated with the cap for preventing backflow from the dispensing tube to the container and for permitting liquid flow from the container to the dispensing tube in response to suction being applied to the dispensing tube. A precise discharge metering orifice is provided in the valve body as a substitution for proportioners which are normally located downstream of the dispensing system. A valve permits ambient air to enter the interior of the container as liquid is drawn therefrom. The valve prevents the flow of liquid therethrough.

2 Claims, 5 Drawing Sheets

CLOSED LOOP DISPENSING SYSTEM

CROSS-REFERENCE TO RELATED APPLICATION

This is a continuation-in-part application of Petitioner's earlier application Ser. No. 10/074,469 filed Feb. 12, 2002, now abandoned entitled CLOSED LOOP DISPENSING SYSTEM WITH METERING ORIFICE.

BACKGROUND OF THE INVENTION

1. Field of the Invention

This invention relates to a closed loop dispensing system and more particularly to a dispensing system for dispensing corrosive liquid chemicals or dangerous medical liquid products which are typically drawn from the upper end of a container, such as a bottle or the like, to a mixing machine or the like. In the instant invention, the container is inverted with the liquid product being drawn from the lower end thereof by vacuum or by gravity flow.

2. Description of the Related Art

Corrosive liquid chemicals and dangerous medical liquid products are typically contained in a container such as a bottle or the like and are frequently dispensed therefrom to a mixing machine. Normally, a cap is placed on the bottle with a dip tube extending therefrom downwardly into the interior of the bottle for drawing the liquid upwardly thereinto. Normally, a dispensing tube extends from the cap to a mixing machine or some other piece of equipment which creates suction in the dispensing tube to draw the liquid from the interior of the bottle. In some prior art devices, when the suction or vacuum is removed from the dispensing tube, backflow may occur. Further, when the cap is removed from the bottle, backflow from the dispensing tube may also occur. Additionally, when the cap is removed from the bottle, liquid residue in the bottle may spill therefrom. Additionally, the conventional prior art systems normally do not prevent the re-use of the bottle which is prohibited in some cases. Yet another disadvantage of the prior art is that a reliable and efficient venting means for the bottle is not normally provided for relieving vacuum pressure from within the bottle. The system of the co-pending application solved the problems associated with the prior art devices or systems.

While the system of the co-pending application works extremely well when the container is in its normal upright condition, the system may not perfectly function when the container of the co-pending application is inverted. When the container or bottle of the co-pending application is inverted, the liquid in the container is drawn or discharged from the normal upper end of the container but which is the lower end of the container in the inverted position. In such a position, the venting membrane, which would normally permit ambient air to replace the liquid in the container as the liquid is discharged from the container, may become "clogged" due to the liquid coming into contact therewith and crystallizing thereon. If air is not permitted to enter the container as the liquid is drawn therefrom, a partial vacuum is created in the upper end of the inverted container which will interfere with the discharge of the liquid therefrom.

SUMMARY OF THE INVENTION

This invention relates to a dispensing system for use with a container, such as a bottle or the like, having an outlet opening formed in the upper end thereof. A cap is removably mounted on the container for selectively closing the outlet opening. A dispensing tube extends from the cap for dispensing liquid from the container either through gravity flow or by suction from a mixing machine or the like. A check valve is associated with the cap for preventing backflow from the dispensing tube to the container. The check valve permits liquid flow from the container to the dispensing system in response to suction or gravity. A container insert or throat plug is positioned in the outlet opening of the bottle and includes a valve therein which is open when the cap is mounted on the container, but which is automatically closed when the cap is removed from the container. The cap has a dispensing opening in communication with the valve in the insert for dispensing liquid from the container when the cap is mounted on the container. The insert includes a vent means for relieving pressure or vacuum in the container. A venting membrane covers the vent means. A valve is in communication with the discharge side of the venting membrane for permitting the flow of air into the container, as liquid is drawn therefrom, while preventing the flow of liquid therethrough.

It is therefore a principal object of the invention to provide an improved dispensing system for corrosive or dangerous liquids contained in a container such as a bottle or the like, when the container is positioned in an inverted condition.

A further object of the invention is to provide a dispensing system which includes a throat plug positioned in the outlet opening of the container and which includes a valve that automatically seals the container when the container cap is removed from the container.

Still another object of the invention is to provide a dispensing system which is safe and convenient to use.

Yet another object of the invention is to provide a dispensing system which is reliable in use.

These and other objects will be obvious to those skilled in the art.

DESCRIPTION OF THE PREFERRED EMBODIMENT

Figure 3:
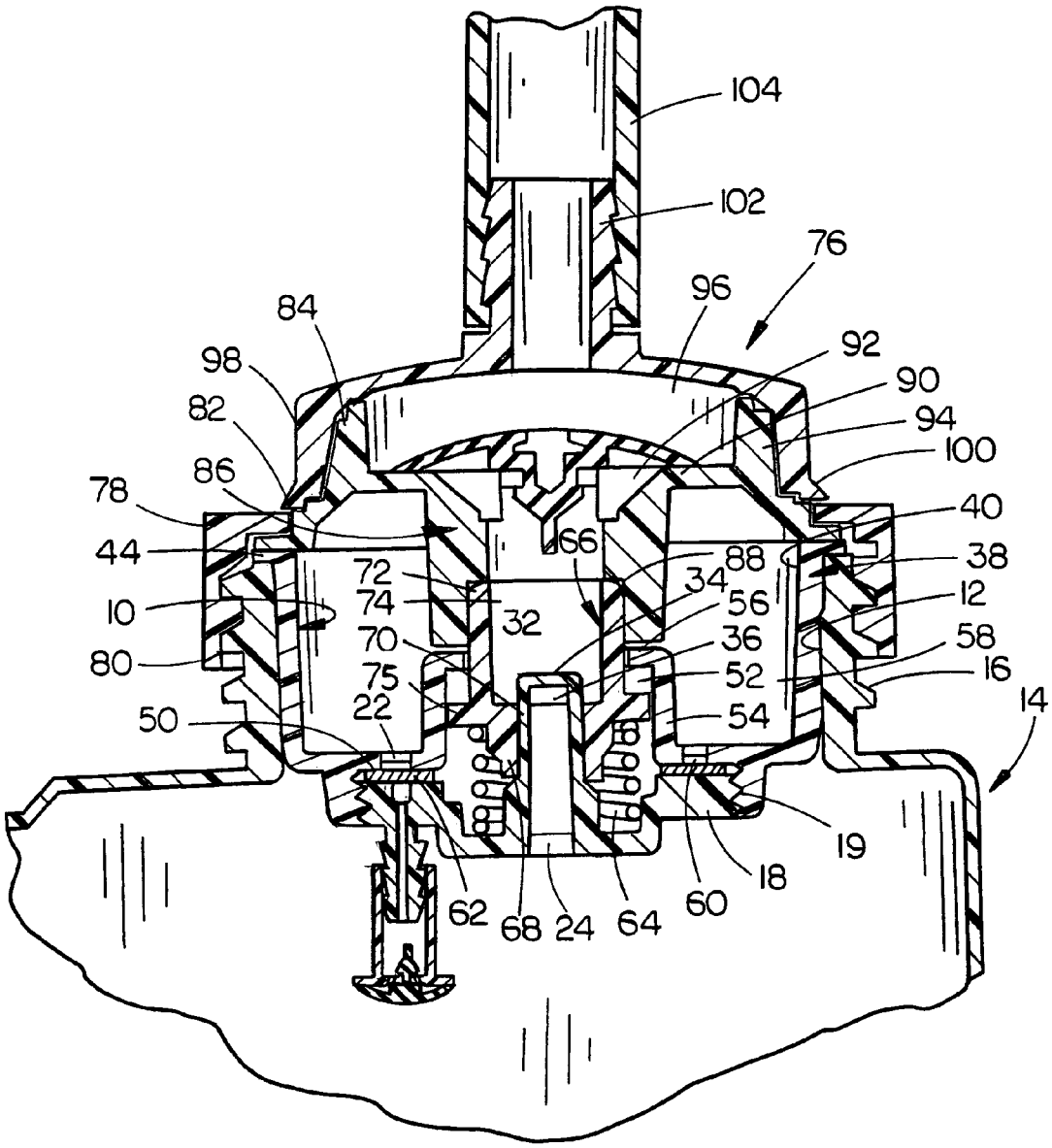
FIG. 3 is a vertical sectional view illustrating the second embodiment of the invention mounted on a container with the container being in an upright position.
Figure 3A:
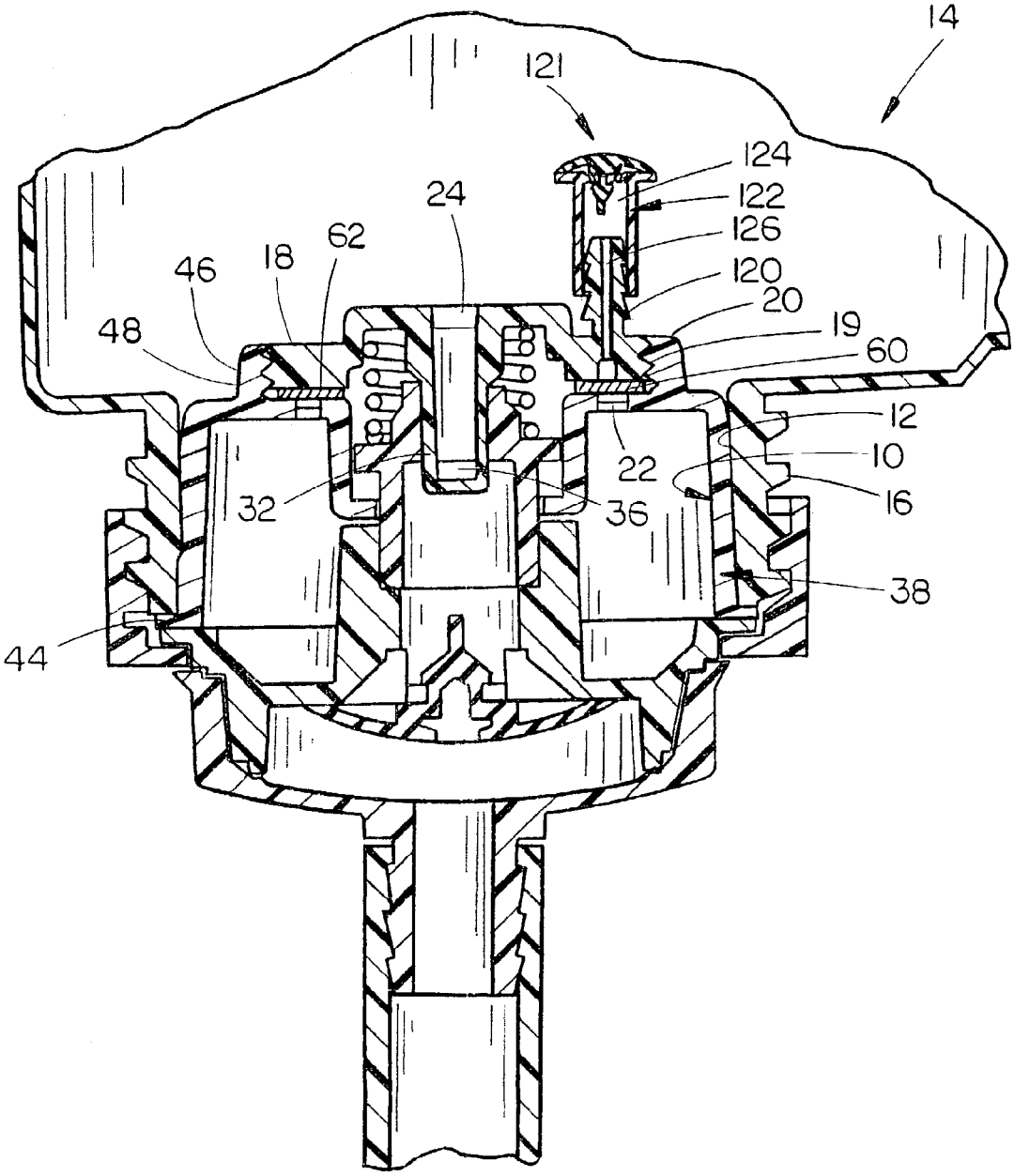
FIG. 3*a* is a vertical sectional view illustrating the second embodiment of the invention mounted on a container with the container being in an inverted position.
Figure 6:
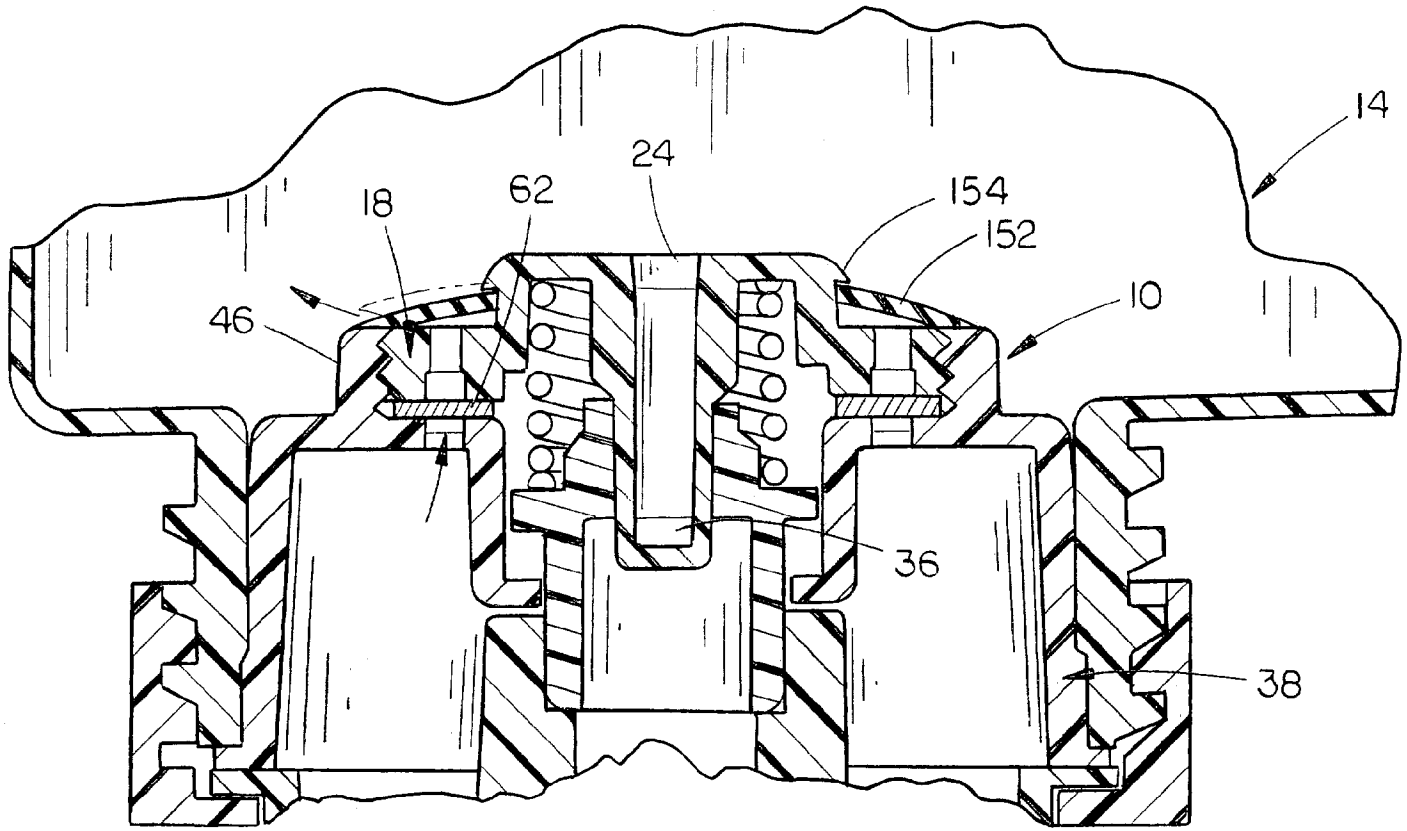
FIG. 6 is a view similar to FIG. 3 except that the third embodiment of the invention is illustrated with the container being in an inverted position.

In the co-pending application, the dispensing thereof is described and shown with the container and the dispensing system being in an upright condition for both shipment and use. In the instant application, the container is shipped and stored in an upright position but is inverted when being used to dispense liquid therefrom. Thus, FIGS. 3 and 6 illustrate the container and dispensing system in an upright position while FIGS. 3*a* and 6*a* illustrated the container and dispensing system in an inverted position. The container and the dispensing apparatus will be initially described as being in the upright condition of FIGS. 3 and 6. However, the operation of the system will be described with the container in the inverted position of FIGS. 3*a* and 6*a*.

Figure 1:
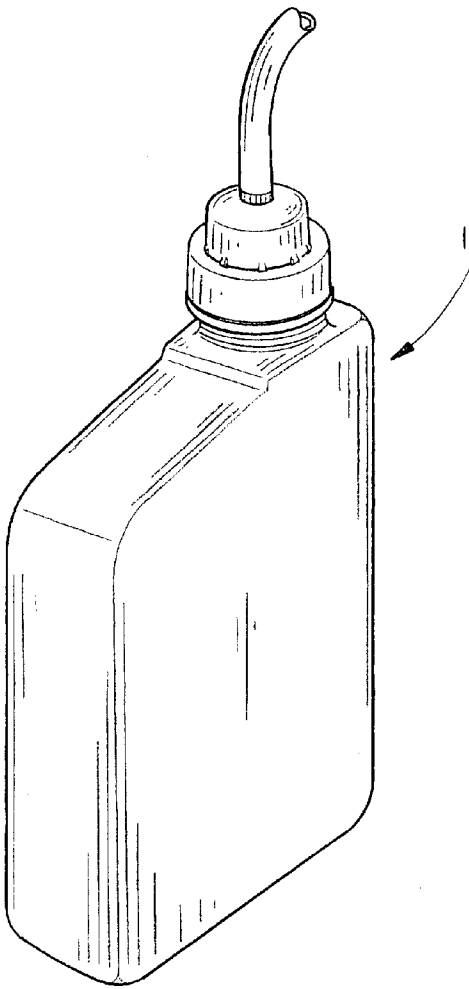
FIG. 1 is a perspective view of a container utilized with the instant invention with the container being in an upright position.

In FIGS. 1, 3 and 6, a container 14 for dispensing liquid is illustrated in an upright condition. The numeral 10 refers to a throat plug assembly which is press-fitted into the throat or outlet opening 12 of the container 14 which normally is a bottle or the like. Preferably, throat 12 includes external threads 16. A conventional cap (not shown) would normally be threadably mounted on the external threads 16 of the throat 12 for shipment or storage. When the bottle is going to dispense liquids, the conventional cap is removed therefrom with the dispensing cap of this invention being substituted therefore.

Assembly 10 includes an externally threaded disc member 18. In certain embodiments, a single opening 20 extends through disc member 18. In another embodiment, a plurality of openings 20 are provided. The upper end of opening 20 communicates with an annular groove 22 formed in the upper surface of the disc member 18. Disc member 18 includes external threads 19 for a purpose to be described hereinafter. Intake opening 24 is formed in disc member 18, as seen in the drawings.

The numeral 32 refers to a hollow valve body which is integrally formed with disc-shaped member 18 with the interior of valve body 32 being in communication with opening 24. The upper end 34 of valve body 32 is closed, as seen in the drawings. The side wall of valve body 32, below the upper end 34, is provided with at least one precise discharge metering orifice 36 with the metering orifice 36 being disposed at right angles to the central vertical channel in valve body 32. The purpose of the precise discharge metering orifice 36 is to offer an economical means to meter the amount of concentrated liquid to be diluted with water achieved by some means of drawing product through the metering orifice (suction or gravity) 36 to a mixing unit or container in the correct volume. If the discharge from the bottle, when inverted, is by gravity, the metering orifice will not be in communication with a suction-type mixing unit.

Throat plug assembly 10 also includes a tapered, cup-shaped plug 38 which is inserted into the throat 12 of the bottle 14, as seen in FIGS. 3 and 6. Plug 38 includes a tapered wall 40 preferably including conventional retention rings on the outer surface thereof to yieldably maintain plug 38 in throat 12. Wall 40 also includes an outwardly extending lip 44 on the upper end thereof for limiting the downward movement of plug 38 with respect to bottle 14.

Plug 38 includes an annular shoulder 46 at its lower end which has internal threads 48 provided thereon for threadably receiving threads 19 of disc member 18. Shoulder 46 also defines an annular recess 50 which extends around a central opening 52 formed in the upstanding, cylindrical receiver 54. Receiver 54 is provided with an inwardly extending lip 56 at its upper end. Receiver 54 has a diameter less than the inside diameter of wall 40 to define an annular recess 58 therebetween. Plug 38 also includes a plurality of vent openings 60 formed in the bottom thereof which extend between recess 50 and recess 58. Venting membrane 62 is received in recess 50 for permitting the passage of air therethrough while preventing the passage of liquid therethrough. As stated, disc member 18 is threadably secured to the lower end of plug 38 so that valve body 32 extends upwardly into receiver 54. As seen, the upper end 34 of valve body 32 is positioned below the upper end of receiver 54.

Spring 64 loosely embraces valve body 32 and is positioned between disc member 18 and valve stem 66. Valve stem 66 is generally cylindrical and includes a lower, cylindrical body portion 68 having bore 70 formed therein which slidably receives valve body 32 therein. It is very important to note that the design of this system positions spring 64 in such a way that the corrosive liquids being dispensed do not come into contact with the spring 64. Valve stem 66 also includes an upper tapered, cylindrical body portion 72 having bore 74 formed therein. Bore 74 has a greater diameter than bore 70, as seen in FIG. 3. Annular shoulder 75 extends outwardly from valve stem 66 between body portions 68 and 72 for engagement with the upper end of spring 64. Valve stem 66 extends upwardly through receiver 54 so that the upper end of body portion 72 is positioned above the upper end of receiver 54. The upper end of spring 64 is in engagement with the underside of shoulder 75 of valve stem 66. Spring 64 normally, yieldably urges valve stem 66 upwardly with respect to receiver 54 so that body portion 68 closes the openings 36 in the valve body 32 to prevent the flow of liquid from the bottle 14 through the throat plug assembly 10. When valve stem 66 is moved downwardly to its lowermost position, as will be described hereinafter, against the spring force of spring 64, the openings 36 are not closed by body portion 68 so that liquid may pass from the interior of valve body 32 into the interior of bore 74.

The numeral 76 refers to the cap portion of this invention. Cap 76 includes a locking collar 78 having internal threads 80 which are adapted to be threadably connected to threads 16 on bottle 14. Collar 78 is provided with a central opening 82 formed therein which has receiver assembly 84 positioned therein which includes a cylindrical receiver 86 extending downwardly therefrom. Receiver 86 has a tapered bore 88 formed therein, the lower end of which is adapted to receive the tapered body portion 72 of valve stem 66. The relationship of tapered bore 88 and tapered body portion 72 provides a seal therebetween and causes receiver 86 to move valve stem 66 downwardly from its upper closed position to its lower open position when collar 78 is screwed onto threads 16 of bottle 14.

Receiver assembly 84 also includes an annular rim portion 90 having a plurality of spaced-apart openings 92 formed therein. Further, receiver assembly 84 includes an upstanding, annular body portion 94 defining a compartment 96. Cup-shaped cap member 98 is snap-fitted onto body portion 94 above collar 78, as seen in FIG. 3, and has a plurality of retention members 100 extending outwardly therefrom which are positioned above the upper end of collar 78. Dispensing tube support 102 extends upwardly from cap member 98 and has dispensing tube 104 mounted thereon which extends to a dispenser, mixer, container, etc.

The dispensing system described above generally functions identically to the dispensing system of the co-pending application except for a very important detail. If the dispensing system of the co-pending application is inverted, the liquid in the container will come into contact with the venting membrane 64 therein by way of the plurality of openings 20 formed in the disc 18 therein. The liquid may crystallize on the membrane to clog the same which will prevent the passage of air therethrough into the container thereby possibly creating a partial vacuum within the container as the liquid is drawn from the container by suction or gravity. It is for that reason that the dispensing system of the co-pending application has been modified to prevent the liquid from coming into contact with the venting membrane to ensure that air may be introduced into the container as the liquid is discharged therefrom to prevent the formation of a partial vacuum within the container.

In the embodiment of FIGS. 3 and 3*a*, only a single opening 20 extends through disc member 18. A support 120 is either secured to disc member 18 or is molded therewith so as to extend into the container 14, as seen in FIGS. 3 and 3*a*. Valve body 122 is mounted on support 120 so that the interior 124 thereof is in communication with the bore 126 of support 120.

Figure 5:
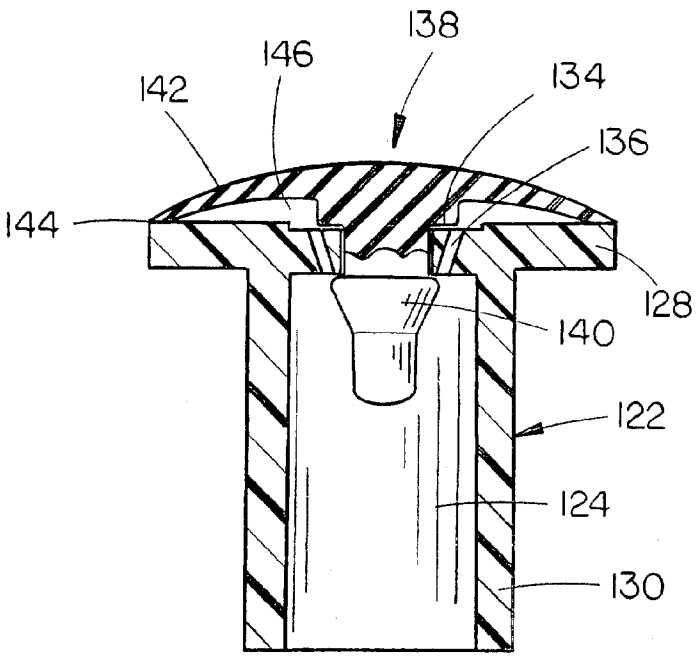
FIG. 5 is a partial vertical sectional view of the valve of FIG. 4.
Figure 4:
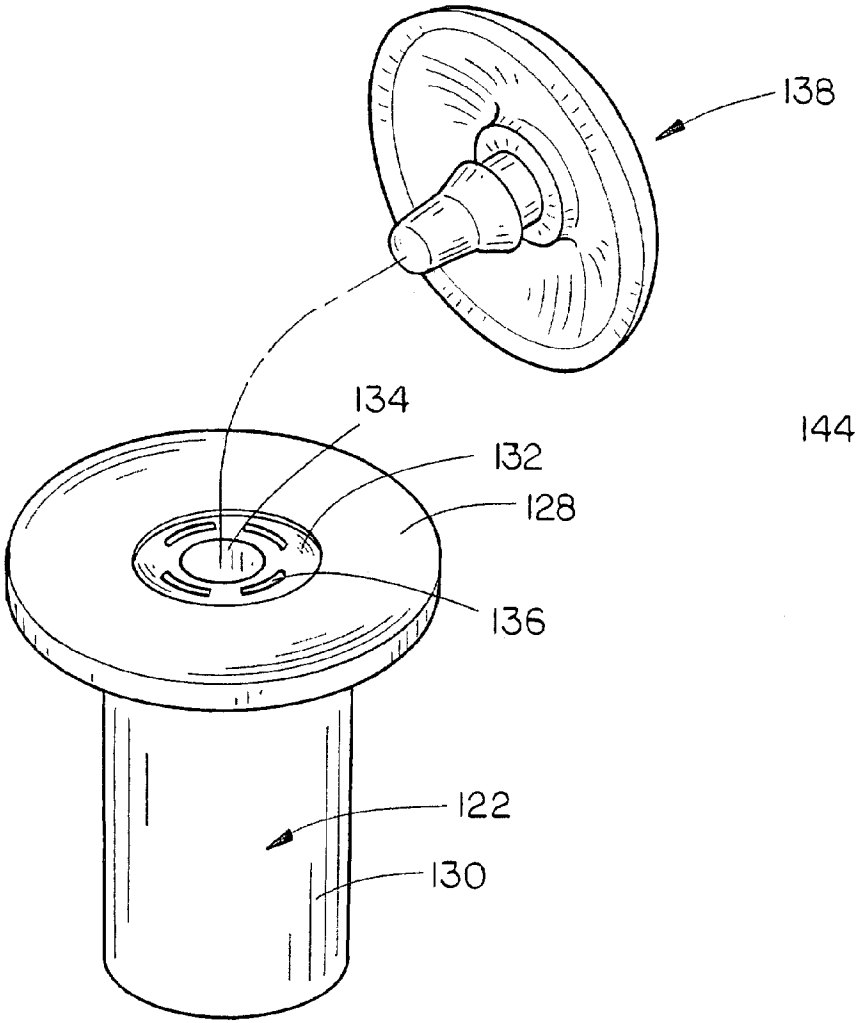
FIG. 4 is an exploded perspective view of the valve utilized in the first and second embodiments.

As seen in FIGS. 3 and 3*a*, bore 126 is in communication with opening 20. Valve body 122 and support 120 may be a single molded piece if so desired. As seen in FIGS. 3*a* and 4, valve body 122 has a disc-shaped upper and 128, the diameter of which is greater than the diameter of body portion 130. The upper surface of upper end 128 is provided with a central recessed area 132 having a central opening 134 extending therethrough, the lower end of which is in communication with interior 124. A plurality of spaced-apart arc-shaped slits or openings 136 extend downwardly from recessed area 132 into the upper end of interior 124. The numeral 138 refers to an umbrella or flap valve including a stem 140 and a flexible dome-shaped head 142. Stem 140 is press-fitted downwardly into opening 134, as seen in FIG. 5, so that the outer periphery of head 142 normally sealably engages the upper surface of upper end 128 of support 120. When in its sealing position of FIG. 5, liquid in the container cannot pass beneath periphery 144 into the compartment area. Even if a small amount of liquid is able to pass beneath periphery 144, the slits 136 are sufficiently small so that the surface tension or viscosity of the liquid will prevent the liquid from passing therethrough.

In operation, as liquid is discharged from the inverted container 14 either by suction or gravity, air may enter the container by passing between elements 98 and 78, thence through the lower notched periphery of element 94 into recess 58, thence into annular groove 22, thence through opening 20, bore 126, interior 124, slits 136 and compartment 146. As the vacuum pressure increases in the upper end of the container 14 as liquid is discharged from the container, the air in compartment 146 will enter the container by bypassing the outer periphery 144 as the same is being lifted from sealing engagement with upper end 128 of 122.

Figure 2:
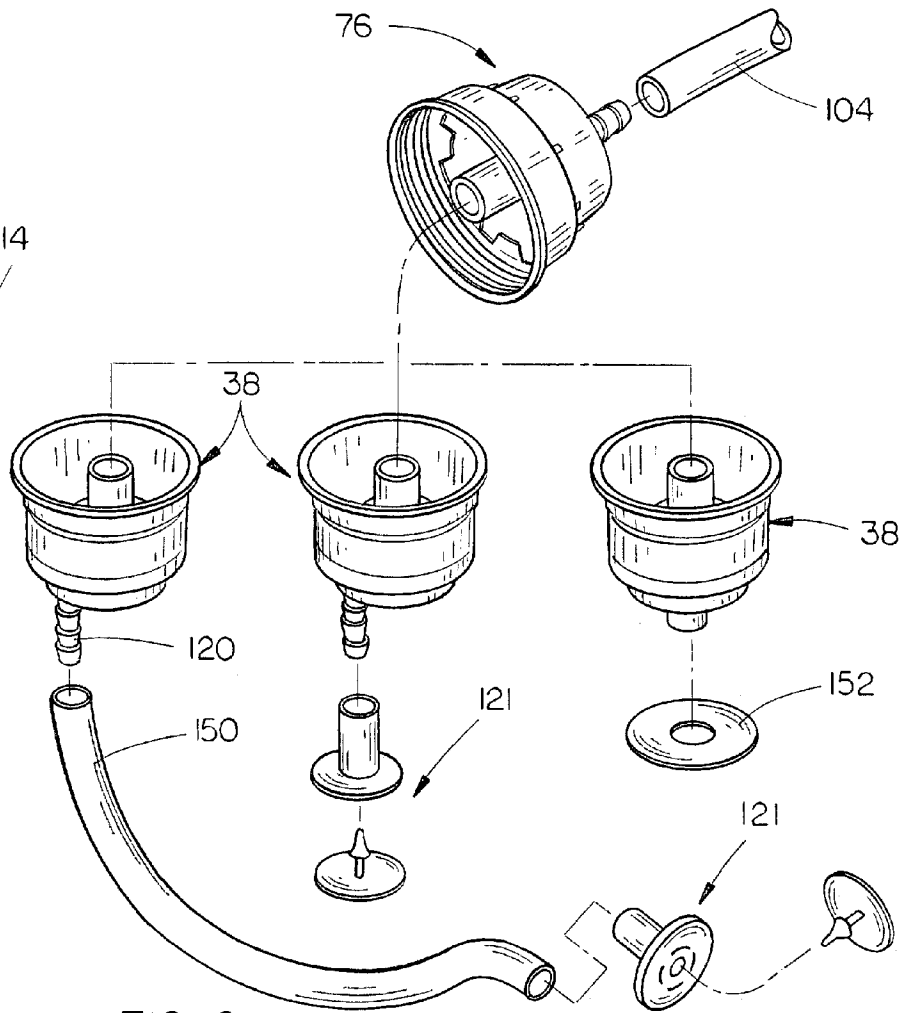
FIG. 2 is an exploded perspective view illustrating first, second and third embodiments of the present invention.

The left-hand side of FIG. 2 illustrates another embodiment of the venting mechanism. This embodiment positions the valve assembly 121 on the upper end of a tube 150 which extends from the support 120 upwardly into the container 14 so that the valve assembly is located in the upper end of the inverted container 14.

Still another embodiment of the venting mechanism is shown at the right-hand side of FIG. 2 and in FIG. 6. In the embodiment of FIG. 6, the disc member 18 is provided with a plurality of spaced-apart openings 20 formed therein as in the co-pending application. A flexible, annular flap valve member 152 is mounted on disc member 18 for yieldably sealing the openings 20. As seen, the inner end of flap valve member 152 is selectively removably maintained on disc member 18 by an annular retainer 154. As the vacuum pressure increases in the container 14 due to the discharge of liquid from the container 14, the other periphery of flap valve member 152 moves out of sealing engagement with disc element 18 and/or throat plug assembly 10 to permit air to pass from openings 20 into the container 14.

In all of the embodiments, ambient air is able to enter the interior of the container in a manner which prevents the liquid from coming into contact with the venting membrane thereby ensuring that the membrane will not become clogged.

Thus it can be seen that the invention accomplishes at least all of its stated objectives.

I claim:

1. In combination, an inverted liquid container having upper and lower ends;

said container having a hollow throat extending downwardly therefrom which has interior and exterior surfaces;

a throat plug assembly, having upper and lower ends, positioned in said throat of said container;

said throat plug assembly having a downwardly extending, hollow valve body, having upper and lower ends, at the upper end thereof;

said valve body having a downwardly extending hollow receiver, including upper and lower ends, below the upper end thereof which has a central opening formed in the lower end thereof;

said valve body having at least one discharge metering orifice formed therein above the lower end thereof;

said valve body having an intake opening formed therein which is in communication with the interior of the container;

said valve body being at least partially positioned within said hollow receiver;

a first valve vertically movably mounted on said valve body which is movable between a lower closed position to an upper open position;

said valve being movably positioned in said central opening of said hollow receiver to close said opening in said valve body when said valve is in its said lower closed position and to open said opening in said valve body when said valve is in its upper open position;

said valve, when in its said upper open position, permitting flow of liquid through said intake opening downwardly through said valve body into the interior of said valve;

a spring in said throat plug assembly which urges said valve into its said lower closed position;

a cap removably mounted on said throat of container for selectively closing said throat;

a dispensing tube extending from said cap for dispensing liquid from said container;

a check valve associated with said cap for preventing backflow from said dispensing tube to said container and which permits liquid flow from said container to said dispensing tube;

said cap including means for engagement with said valve to move said valve upwardly to its said upper open position when said cap is mounted on said container to close said throat;

said throat plug assembly including a second mechanical valve associated therewith which permits ambient air to pass therethrough into the container as liquid is drawn therefrom;

said second mechanical valve preventing the flow of liquid therethrough.

2. The combination of claim 1 wherein said check valve comprises a normally closed flexible umbrella valve which opens in response to liquid passing therethrough from said container.

* * * * *